US010159321B1

(12) United States Patent
Gooden

(10) Patent No.: US 10,159,321 B1
(45) Date of Patent: Dec. 25, 2018

(54) BALL CAP STORAGE APPARATUS

(71) Applicant: Weldon Gooden, Lakewood, CA (US)

(72) Inventor: Weldon Gooden, Lakewood, CA (US)

( * ) Notice: Subject to any disclaimer, the term of this patent is extended or adjusted under 35 U.S.C. 154(b) by 0 days.

(21) Appl. No.: 15/248,963

(22) Filed: Aug. 26, 2016

(51) Int. Cl.
*A45C 11/02* (2006.01)
*B65D 85/18* (2006.01)
*A45C 13/00* (2006.01)

(52) U.S. Cl.
CPC ..... *A45C 11/02* (2013.01); *A45C 13/001* (2013.01); *B65D 85/18* (2013.01)

(58) Field of Classification Search
CPC ..... A45C 11/02; A45C 13/001; B65D 85/18
See application file for complete search history.

(56) References Cited

U.S. PATENT DOCUMENTS 5,022,515 A * 6/1991 Agostine ..... A45C 11/02 190/13 G
5,172,837 A * 12/1992 Finney, Jr. ..... A42B 1/002 2/209.5
5,480,023 A 1/1996 Puller
6,125,997 A * 10/2000 Campbell ..... A45C 11/02 206/278
7,147,112 B2 12/2006 Penson
8,177,104 B2 * 5/2012 Bryant ..... A42B 1/002 223/12
8,220,673 B1 * 7/2012 Levin ..... A42B 1/002 206/8

* cited by examiner

*Primary Examiner* — Tri Mai

(57) ABSTRACT

A ball cap storage apparatus including a caged upper frame and a caged lower frame. The caged upper frame further includes an obround first support member, a plurality of dome-shaped second support members, a dome-shaped third support member, and a bill-shaped fourth member. The caged lower frame has an obround first support portion and a bill-shaped second support portion attached to and extended outward from a bottom section of the obround first support portion. The bill-shaped second support portion is hingedly attached to the bill-shaped fourth member. At least one locking clip is rotatably attached to at least one of the obround first support member and the bill-shaped fourth member. The at least one locking clip is selectively engageable with at least one of the obround first support portion and the bill-shaped second support portion.

3 Claims, 5 Drawing Sheets

BALL CAP STORAGE APPARATUS

BACKGROUND OF THE INVENTION

Various types of hat containers are known in the prior art. However, what has been needed is a ball cap storage apparatus including a caged upper frame and a caged lower frame, with the caged upper frame further including an obround first support member, a plurality of dome-shaped second support members, a dome-shaped third support member, and a bill-shaped fourth member; and the caged lower frame having an obround first support portion and a bill-shaped second support portion attached to and extended outward from a bottom section of the obround first support portion. What has been further needed is for the bill-shaped second support portion to be hingedly attached to the bill-shaped fourth member. Lastly, what has been needed is for at least one locking clip to be rotatably attached to at least one of the obround first support member and the bill-shaped fourth member, with the at least one locking clip selectively engageable with at least one of the obround first support portion and the bill-shaped second support portion. At least one ball cap is removably disposable between the caged upper frame and the caged lower frame when the at least one locking clip is engaged with at least one of the obround first support portion of the caged lower frame and the substantially bill-shaped second support portion of the caged lower frame. The caged structure of the ball cap storage apparatus thus serves to protect each of a wearer's plurality of ball caps during travel and storage.

FIELD OF THE INVENTION

The present invention relates to hat containers, and more particularly, to a ball cap storage apparatus.

SUMMARY OF THE INVENTION

The general purpose of the present ball cap storage apparatus, described subsequently in greater detail, is to provide a bll cap storage apparatus which has many novel features that result in a ball cap storage apparatus which is not anticipated, rendered obvious, suggested, or even implied by prior art, either alone or in combination thereof.

To accomplish this, the present ball cap storage apparatus includes a caged upper frame and a caged lower frame. The caged upper frame further includes an obround first support member, a plurality of dome-shaped second support members, a flattened dome-shaped third support member, and a substantially bill-shaped fourth member. The obround first support member has a right side portion, a left side portion, a top portion, and a bottom portion. Each of the plurality of dome-shaped second support members has a right end attached to the right side portion of the obround first support member and a left end attached to the left side portion of the obround first support member. The flattened dome-shaped third support member has a top end attached to the top portion of the obround first support member and a bottom end attached to the bottom portion of the obround first support member. The flattened dome-shaped third support member is disposed through each of the plurality of dome-shaped second support members. The substantially bill-shaped fourth member is attached to and extended outward from the bottom portion of the obround first support member. The substantially bill-shaped fourth member has a linear front portion.

The caged lower frame has an obround first support portion and a substantially bill-shaped second support portion attached to and extended outward from a bottom section of the obround first support portion. A linear front section of the substantially bill-shaped second support portion is hingedly attached to the linear front portion of the substantially bill-shaped fourth member of the caged upper frame.

A circumference of the obround first support member of the caged upper frame is equal to a circumference of the obround first support portion of the caged lower frame, and a circumference of the substantially bill-shaped fourth member of the caged upper frame is equal to a circumference of the substantially bill-shaped second support portion of the caged lower frame. At least one locking clip is rotatably attached to at least one of the obround first support member of the caged upper frame and the substantially bill-shaped fourth member of the caged upper frame, and the at least one locking clip is selectively engageable with at least one of the obround first support portion of the caged lower frame and the substantially bill-shaped second support portion of the caged lower frame. At least one ball cap is removably disposable between the caged upper frame and the caged lower frame when the at least one locking clip is engaged with at least one of the obround first support portion of the caged lower frame and the substantially bill-shaped second support portion of the caged lower frame.

The plurality of dome-shaped second support members of the caged upper frame is optionally three, and the at least one locking clip is optionally seven to ensure that the at least one ball cap remains securely disposed between the caged upper frame and the caged lower frame. The ball cap storage apparatus thus provides a user with a structure that allows for the storage and transportation of a plurality of ball caps while ensuring that the semi-rigid structure of each of the plurality of ball caps remains intact.

Thus has been broadly outlined the more important features of the present ball cap storage apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
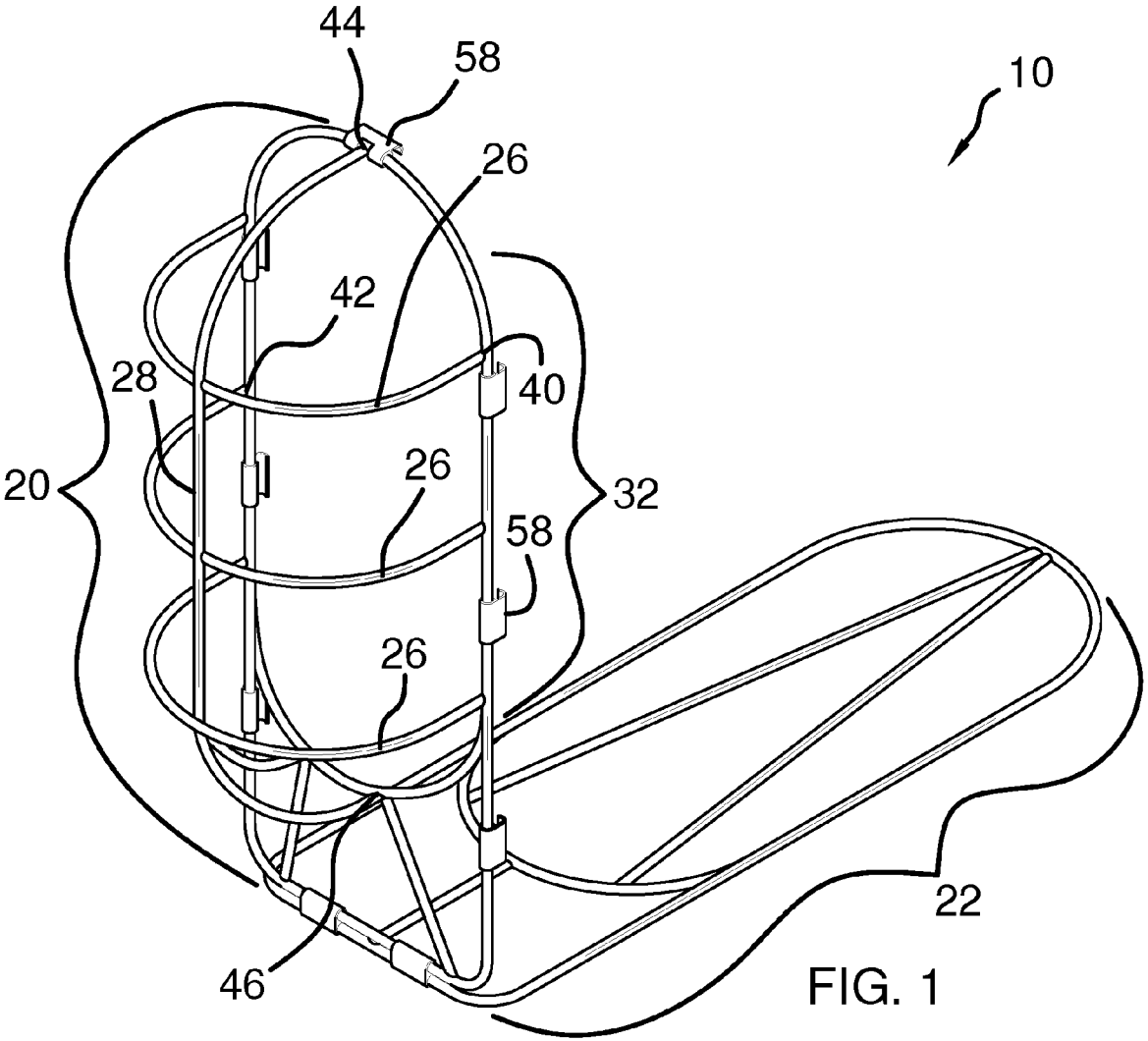
FIG. 1 is a front isometric view.
Figure 2:
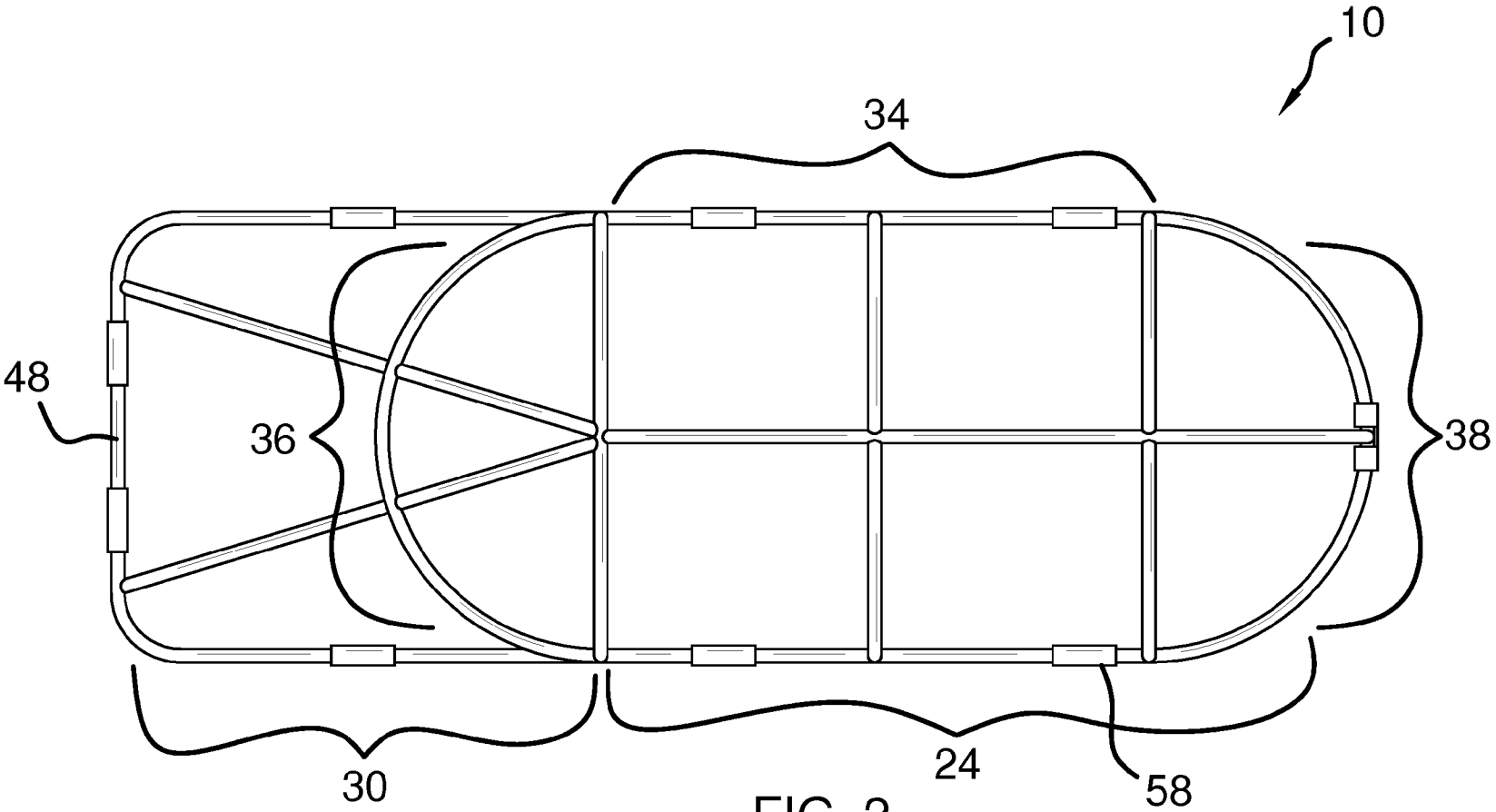
FIG. 2 is a top plan view.
Figure 3:
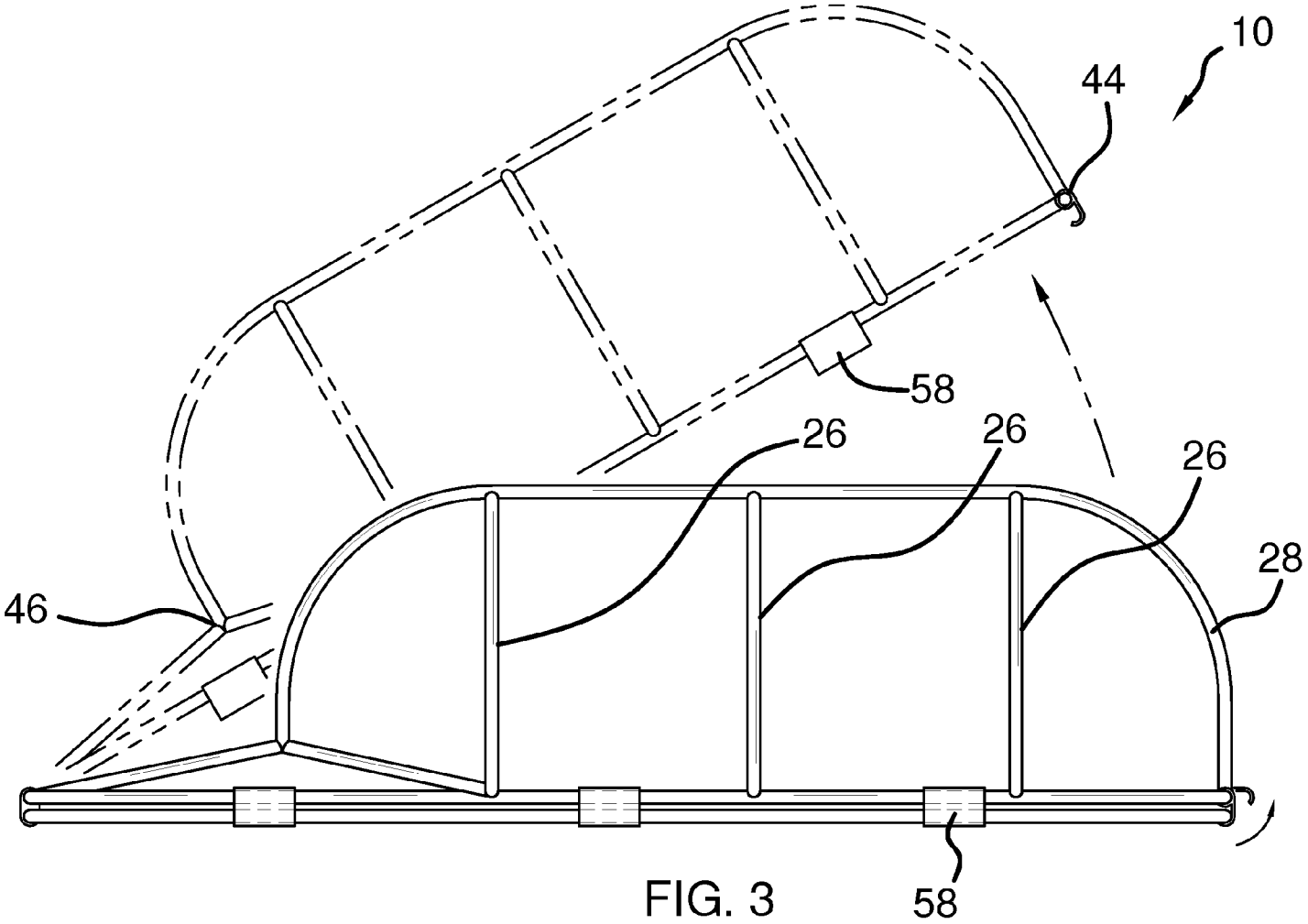
FIG. 3 is a side elevation view.
Figure 4:
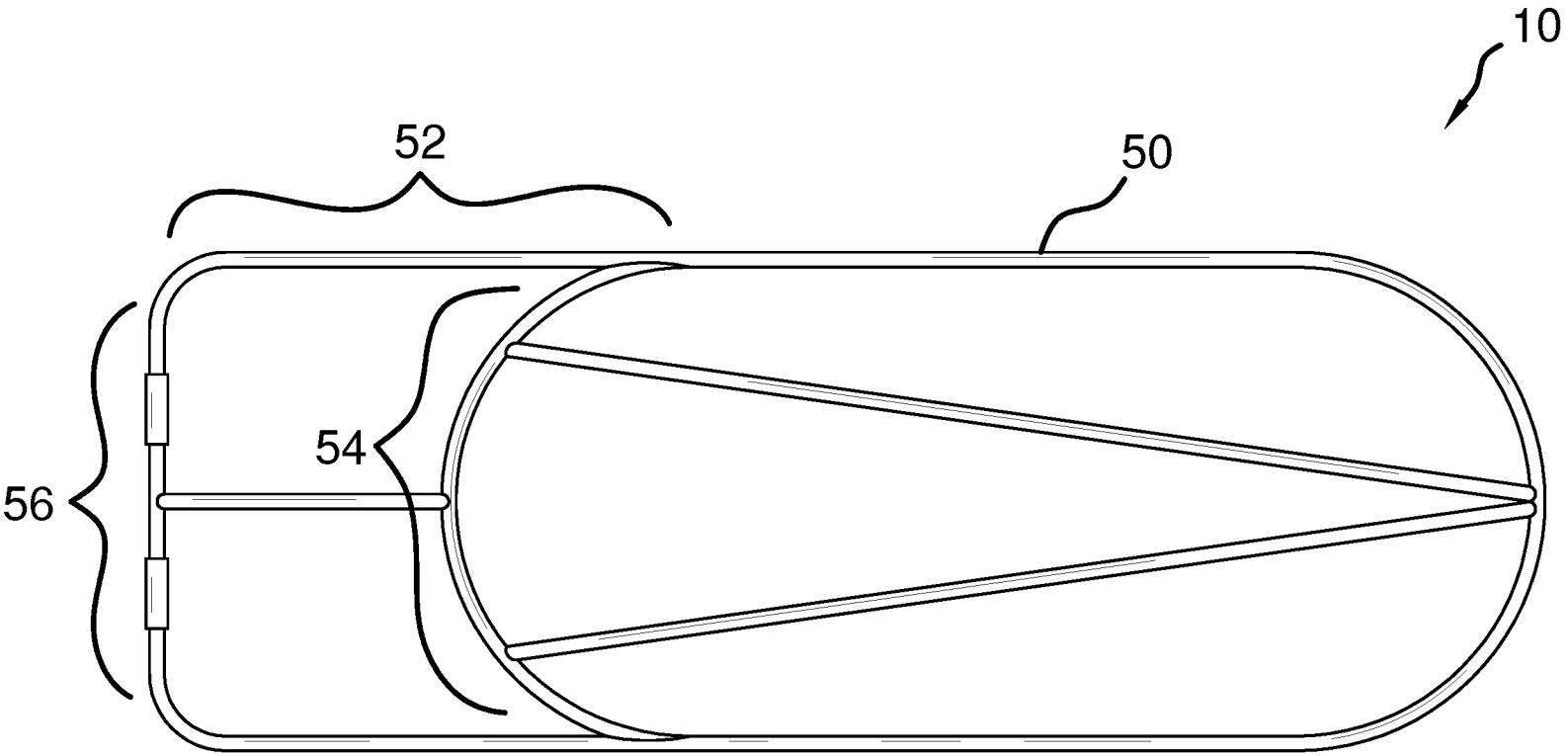
FIG. 4 is a bottom plan view showing a caged lower frame.
Figure 5:
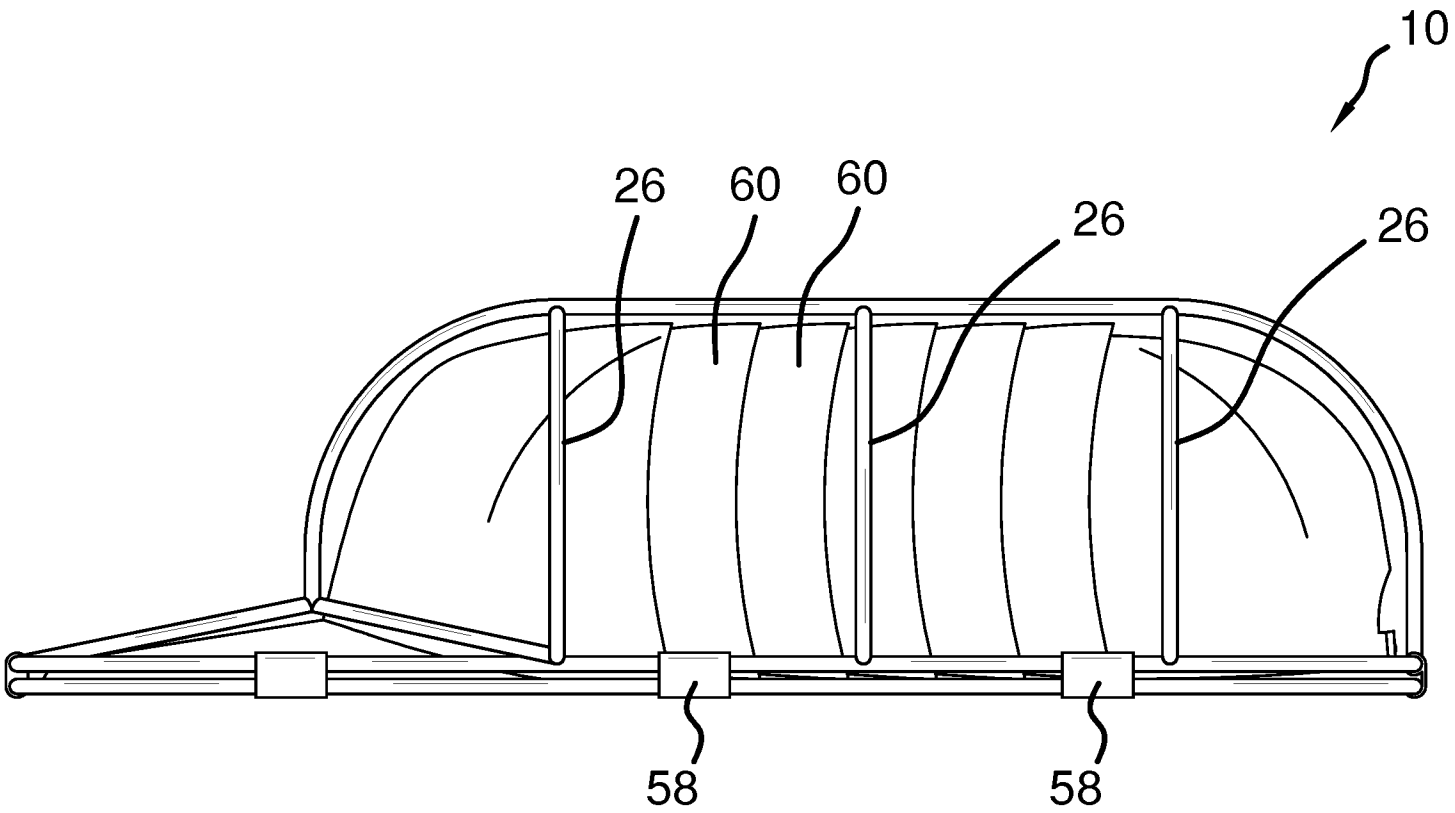
FIG. 5 is an in use view.

With reference now to the drawings, and in particular FIGS. 1 through 5 thereof, an example of the instant ball cap storage apparatus employing the principles and concepts of the present ball cap storage apparatus and generally designated by the reference number 10 will be described.

Referring to FIGS. 1 through 5 the present ball cap storage apparatus 10 is illustrated. The ball cap storage apparatus 10 includes a caged upper frame 20 and a caged lower frame 22. The caged upper frame 20 further includes an obround first support member 24, a plurality of dome-shaped second support members 26, a flattened dome-shaped third support member 28, and a substantially bill-shaped fourth member 30. The obround first support member 24 has a right side portion 32, a left side portion 34, a top portion 36, and a bottom portion 38. Each of the plurality of dome-shaped second support members 26, optionally three, has a right end 40 attached to the right side portion 32 of the obround first support member 24 and a left end 42 attached to the left side portion 34 of the obround first support member 24. The flattened dome-shaped third support member 28 has a top end 44 attached to the top portion 36 of the obround first support member 24 and a bottom end 46 attached to the bottom portion 38 of the obround first support member 24. The flattened dome-shaped third support member 28 is disposed through each of the plurality of dome-shaped second support members 26. The substantially bill-shaped fourth member 30 is attached to and extended outward from the bottom portion 38 of the obround first support member 24. The substantially bill-shaped fourth member 30 has a linear front portion 48.

The caged lower frame 22 has an obround first support portion 50 and a substantially bill-shaped second support portion 52 attached to and extended outward from a bottom section 54 of the obround first support portion 50. A linear front section 56 of the substantially bill-shaped second support portion 52 is hingedly attached to the linear front portion 48 of the substantially bill-shaped fourth member 30 of the caged upper frame 20.

At least one locking clip 58, optionally seven, is rotatably attached to at least one of the obround first support member 24 of the caged upper frame 20 and the substantially bill-shaped fourth member 30 of the caged upper frame 20, and the at least one locking clip 58 is selectively engageable with at least one of the obround first support portion 50 of the caged lower frame 22 and the substantially bill-shaped second support portion 52 of the caged lower frame 22. At least one ball cap 60 is removably disposable between the caged upper frame 20 and the caged lower frame 22 when the at least one locking clip 58 is engaged with at least one of the obround first support portion 50 of the caged lower frame 22 and the substantially bill-shaped second support portion 52 of the caged lower frame 22.

What is claimed is:

1. A ball cap storage apparatus comprising:

a caged upper frame further comprising:

an obround first support member having a right side portion, a left side portion, a top portion, and a bottom portion;

a plurality of dome-shaped second support members, each of the plurality of dome-shaped second support members having a right end attached to the right side portion of the obround first support member and a left end attached to the left side portion of the obround first support member;

a flattened dome-shaped third support member having a top end attached to the top portion of the obround first support member and a bottom end attached to the bottom portion of the obround first support member, wherein the flattened dome-shaped third support member is disposed through each of the plurality of dome-shaped second support members; and a substantially bill-shaped fourth member attached to and extended outward from the bottom portion of the obround first support member, wherein the substantially bill-shaped fourth member has a linear front portion;

a caged lower frame having an obround first support portion and a substantially bill-shaped second support portion attached to and extended outward from a bottom section of the obround first support portion, wherein a linear front section of the substantially bill-shaped second support portion is hingedly attached to the linear front portion of the substantially bill-shaped fourth member of the caged upper frame;

wherein a circumference of the obround first support member of the caged upper frame is equal to a circumference of the obround first support portion of the caged lower frame;

wherein a circumference of the substantially bill-shaped fourth member of the caged upper frame is equal to a circumference of the substantially bill-shaped second support portion of the caged lower frame; and at least one locking clip rotatably attached to at least one of the obround first support member of the caged upper frame and the substantially bill-shaped fourth member of the caged upper frame, wherein the at least one locking clip is selectively engageable with at least one of the obround first support portion of the caged lower frame and the substantially bill-shaped second support portion of the caged lower frame, wherein at least one ball cap is removably disposable between the caged upper frame and the caged lower frame when the at least one locking clip is engaged with at least one of the obround first support portion of the caged lower frame and the substantially bill-shaped second support portion of the caged lower frame.

2. The ball cap storage apparatus of claim 1 wherein the plurality of dome-shaped second support members of the caged upper frame is three.

3. The ball cap storage apparatus of claim 2 wherein the at least one locking clip is seven.

* * * * *